US007207906B1

(12) United States Patent
Gregory

(10) Patent No.: US 7,207,906 B1
(45) Date of Patent: Apr. 24, 2007

(54) COLLAPSIBLE BASKETBALL RETURN DEVICE

(75) Inventor: David G. Gregory, Coos Bay, OR (US)

(73) Assignee: Michael J. Panaggio, Daytona Beach, FL (US), part interest ( * ) Notice: Subject to any disclaimer, the term of this patent is extended or adjusted under 35 U.S.C. 154(b) by 306 days.

(21) Appl. No.: 11/050,041

(22) Filed: Feb. 2, 2005

Related U.S. Application Data

(60) Provisional application No. 60/553,422, filed on Mar. 12, 2004.

(51) Int. Cl.
*A63B 69/00* (2006.01)

(52) U.S. Cl. ..... 473/432

(58) Field of Classification Search ..... 473/433, 473/432, 431, 489; 182/150, 222, 152
See application file for complete search history.

(56) References Cited

U.S. PATENT DOCUMENTS 1,371,867 A * 3/1921 Dean ..... 273/397
3,233,896 A * 2/1966 King ..... 473/433
4,838,549 A * 6/1989 Woodall ..... 473/433
5,183,253 A * 2/1993 Grimaldi et al. ..... 473/433
5,310,176 A * 5/1994 Berg ..... 473/433
5,312,099 A * 5/1994 Oliver, Sr. ..... 473/433
5,393,049 A * 2/1995 Nelson ..... 473/433
5,746,668 A * 5/1998 Ochs ..... 473/433
5,813,926 A * 9/1998 Vance ..... 473/448
6,056,652 A * 5/2000 Lees et al. ..... 473/433
6,267,696 B1 * 7/2001 Mabe et al. ..... 473/433
6,458,049 B2 * 10/2002 Bush ..... 473/433
6,659,893 B1 * 12/2003 Campbell et al. ..... 473/459

* cited by examiner

*Primary Examiner*—Eugene Kim
*Assistant Examiner*—M. Chambers
(74) *Attorney, Agent, or Firm*—Robert E. Howard

(57) ABSTRACT

A collapsible basketball return device including pairs of front and rear vertical telescoping posts. Lower and upper horizontal telescoping side support arms extend between a lower portion of each of the front and rear posts. Lower and upper horizontal telescoping end support arms extend between the lower portions of each of the front posts and each of the rear posts, respectively. A net is suspended from the telescoping posts and forms a tunnel in its lower portion that slopes toward and beyond the front of the device when in its fully erected mode. The net is open at its top and the outer end of the tunnel is attached to a discharge chute aimed at the user. The discharge chute is attached to the front telescoping posts by telescoping and rotatable chute support arms.

13 Claims, 4 Drawing Sheets

COLLAPSIBLE BASKETBALL RETURN DEVICE

CROSS-REFERENCE TO RELATED APPLICATIONS

This application claims the benefit of U.S. Provisional Application No. 60/553,422, filed Mar. 12, 2004.

BACKGROUND OF THE INVENTION

The present invention relates to a collapsible basketball return device for use in conjunction with a conventional basketball goal.

Like all sports, basketball requires many types of practice exercises. One such exercise is shooting baskets from a particular location on the floor, especially practicing free-throws from the free-throw line. Typically such practice involves the person shooting the baskets and one or more other persons to return balls to the shooter.

It would be very desirable to have a device that would automatically return balls to the shooter to free up other personnel for other purposes and to allow the shooter to practice by himself or herself.

SUMMARY OF THE INVENTION

It is an object of the present invention to provide a device for automatically returning basketballs shot at a basketball goal to the shooter.

It is a further object of the present invention to provide a device for automatically returning basketballs that is easily collapsible for storage and easily erected for use.

The collapsible basketball return device of the present invention includes pairs of front and rear vertical telescoping posts having tubular lower, central and upper portions. A pair of lower and upper horizontal telescoping side support arms extend between a lower portion of each of the front and rear posts. A pair of lower and upper horizontal telescoping end support arms extend between a lower portion of each of the front posts and between a lower portion of each of the rear posts, respectively.

A net is suspended from the telescoping posts and slopes toward the front of the device. The net is open at its top and is attached to a discharge chute at its bottom. The discharge chute is attached to the front telescoping posts by telescoping and rotatable support arms.

DESCRIPTION OF THE PREFERRED EMBODIMENTS

Figure 1:
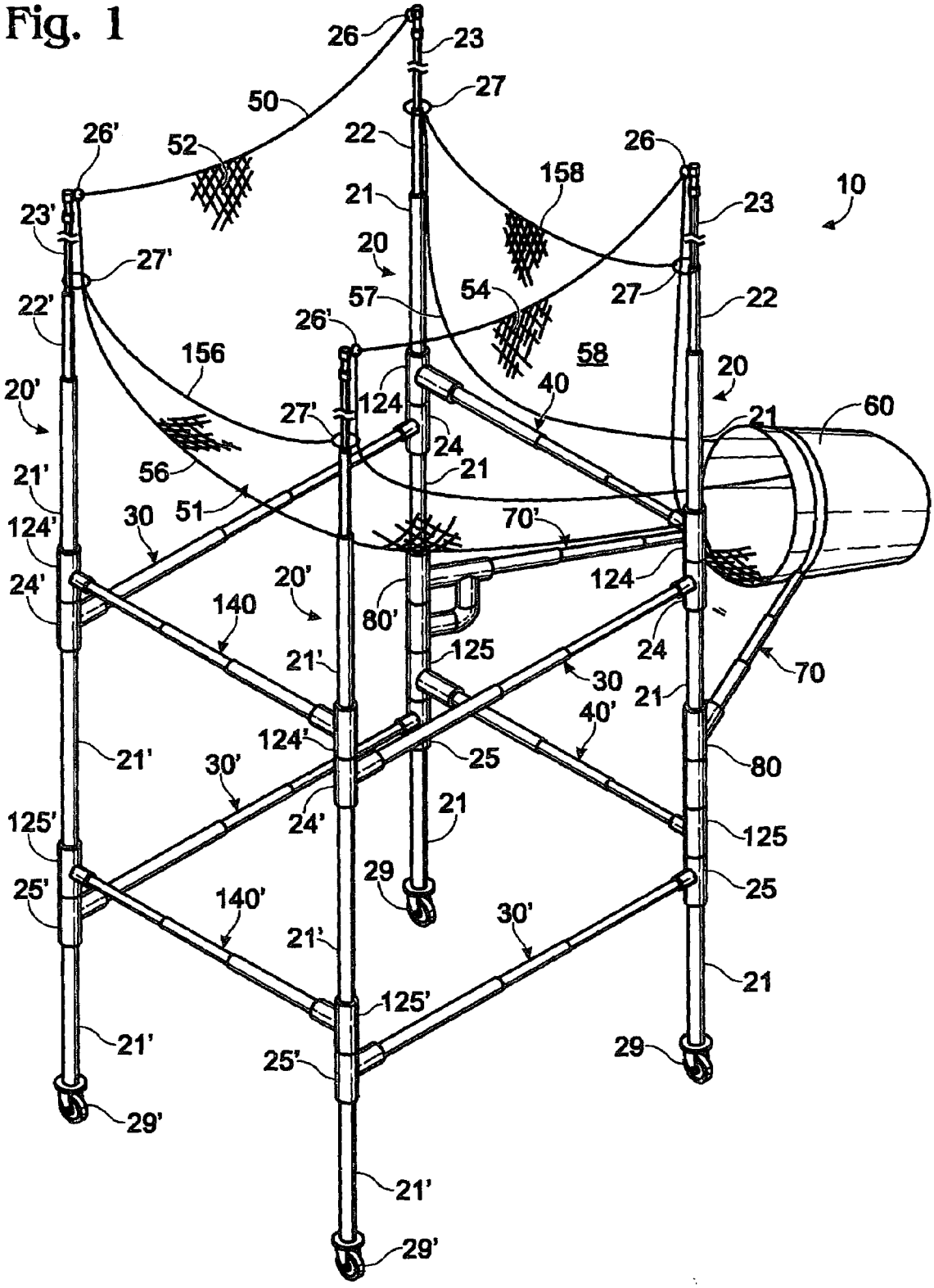
FIG. 1 is a rear right side perspective view of the basketball return device of the present invention, shown in its fully deployed configuration.

The basketball return device 10 of the present invention has a framework that includes: two vertical telescoping front posts 20 and two vertical telescoping rear posts 20', respectively; two horizontal telescoping upper side support arms 30, respectively; two horizontal telescoping lower side support arms 30', respectively; upper and lower horizontal telescoping front end support arms 40 and 40', respectively; and upper and lower horizontal telescoping rear end support arms 140 and 140', respectively.

Figure 4:
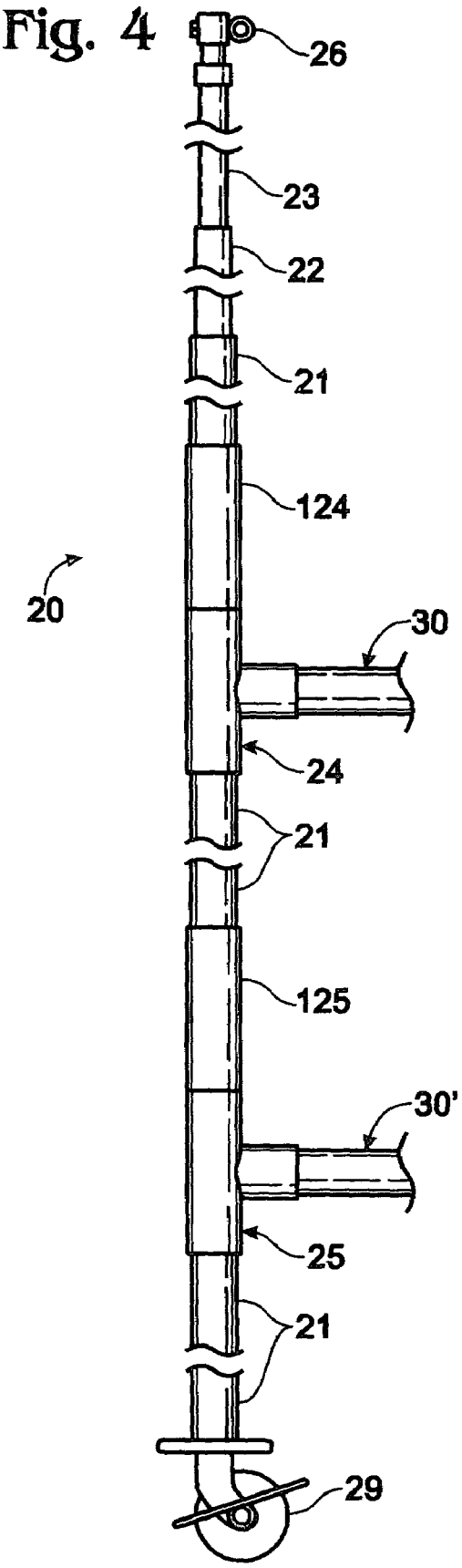
FIG. 4 is a side elevational view of the left front vertical telescoping post of the basketball return device of the present invention.

The four vertical telescoping posts 20 and 20' are identical in construction. One such post 20 is illustrated in FIG. 4, it being understood that posts 20' have the same elements with the same reference numbers used for post 20 but with a prime added thereto. Telescoping post 20 includes a tubular lower portion (bottom leg portion) 21, a tubular central portion (middle leg portion) 22 and a tubular upper portion (top leg portion) 23. The total height of each of the telescoping posts 20 and 20' in their fully extended position is preferably such that the upper ends of upper portions 23 and 23' are between the height of the rim and the height of the upper edge of a basketball backboard.

The diameter of upper portion 23 is smaller than the diameter of central portion 22, and upper portion 23 is adapted to be telescopingly received within central portion 22. Similarly, the diameter of central portion 22 is smaller than the diameter of lower portion 21, and central portion 22 is adapted to be telescopingly received within lower portion 21.

In the fully extended position of telescoping posts 20 and 20' (substantially as shown in FIG. 4), central portions 22 and 22' are held in place in their extended position by any suitable releasable means, such as a snug fit or use of an opposing hole and detent arrangement (not shown). Similarly, in the fully extended position of telescoping posts 20 and 20' (substantially as shown in FIG. 4), upper portions 23 and 23' are held in place in their extended position by any suitable means, such as a snug fit or use of an opposing hole and detent arrangement (not shown).

Pipe couplers 24, 24', 25 and 25' are identical in configuration and are non-rotatably attached to upper and lower portions of bottom leg portions 21, 21', as shown. The horizontal arms of couplers 24 and 24' are adapted to receive one end of side support arms 30 and the lower horizontal arms of couplers 25, 25' are adapted to receive one end of end support arms 30', respectively.

Caster wheels 29 and 29' are attached to the lower ends of bottom leg portions 21 and 21', respectively, to make the device more mobile, particularly during movement into storage.

Figure 5:
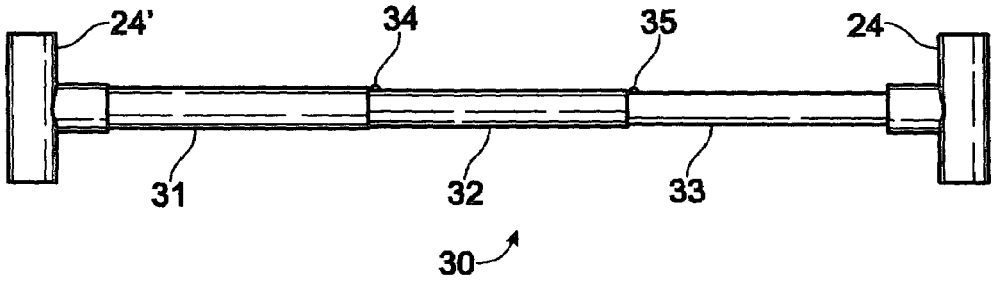
FIG. 5 is an outer side elevational view of the upper right horizontal telescoping side support arm of the basketball return device of the present invention.

All four horizontal telescoping side support arms 30 and 30' are identical in construction, the upper right support arm 30 being shown in FIG. 5. Side support arms 30' have the same elements as side support arm 30, and are identified by the same reference numbers but to which a prime has been added. Support arm 30 includes spaced apart tubular sections 31, 32 and 33. The diameter of section 31 is greater than the diameter of section 32 which is greater than the diameter of section 33. Detents may be used to hold the sections in their fully extended positions.

All four horizontal telescoping front and rear support arms 40, 40', 140 and 140' are similar in configuration to side support arms 30 and 30', their fully extended length being shorter.

Pipe couplers 124 and 124' located adjacent to pipe couplers 24, 24', 25 and 25', and are rotatable about bottom leg portion 21 and 21', respectively. The horizontal arms of couplers 124 and 124' are adapted to receive one end of front and rear support arms 40, 40', 140 and 140'.

Eyebolts 26 and 26' are attached to the outer end of upper portions 23 and 23' of each of the four vertical posts 20 and 20', respectively. A continuous cord 50, such as a bungee cord, extends between both front and rear posts 20 and 20', through eyebolts 26 and 26', down at least a portion of upper portions 23 and 23' of posts 20 and 20', through unattached (floating) rings 27 and 27', and between rear posts 20' and between front posts 20.

A net 51 includes net side portions 52 and 54 which are attached to, and extend downwardly from, that portion of cord 50 extending between front and rear posts 20 and 20'.

A generally triangular-shaped rear end net portion 56 is attached to, and extends downwardly from, that portion of cord 50 extending between rear posts 20'. The sides of rear end net portion 56 are attached to or integral with side net portions 52 and 54, as best seen in FIG. 1. The upper edge 156 of rear end net 56 portion is adapted to be located just below the arm attaching the basketball hoop to the backboard when rear posts 20' are fully extended.

A front end net portion 58 has an upper edge 158 which is attached to and extends downwardly from that portion of cord 50 extending between front posts 20, with the sides thereof being attached to or integral with side net portions 52 and 54 in a manner identical to rear end net portion 56. However, the upper edge 158 of front end net portion 58 is lower than the upper edge 156 of rear end net portion 56 in order to not interfere with the trajectory of basketballs shot at the basket.

Side net portions 52 and 54, rear end net portion 56, and front end net portion 58 form a tunnel-like configuration at the lower front end of return device 10.

The tunnel-like configuration formed by side net portions 52,54 and rear and front net portions 56 and 58 is attached at its outer end to a hollow basketball discharge chute 60. Discharge chute 60 has an inside diameter larger than the diameter of a basketball.

Figure 2:
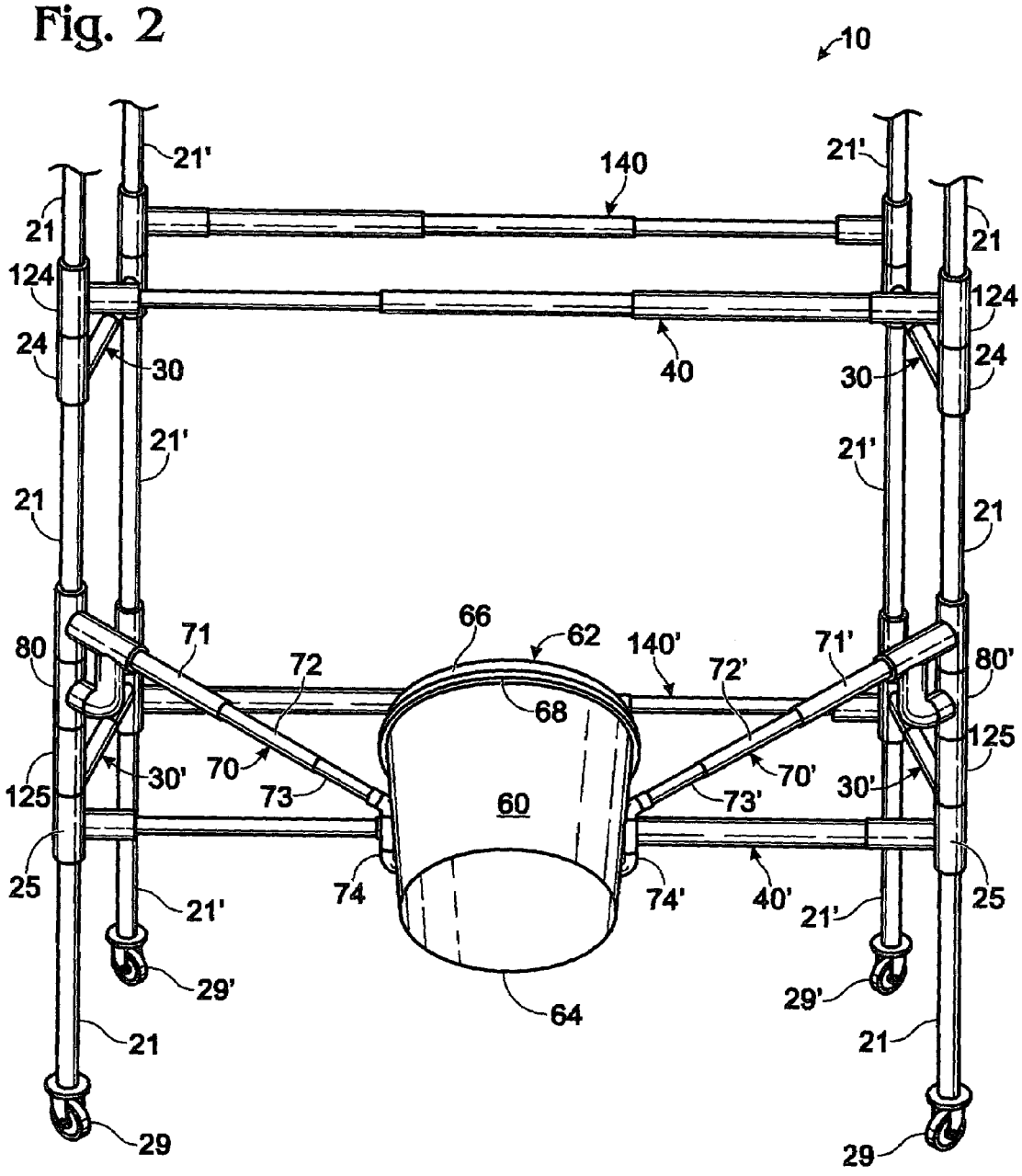
FIG. 2 is a partial front elevational view of the basketball return device with the discharge chute and its telescoping and rotatable support arms shown in their fully deployed configuration.
Figure 3:
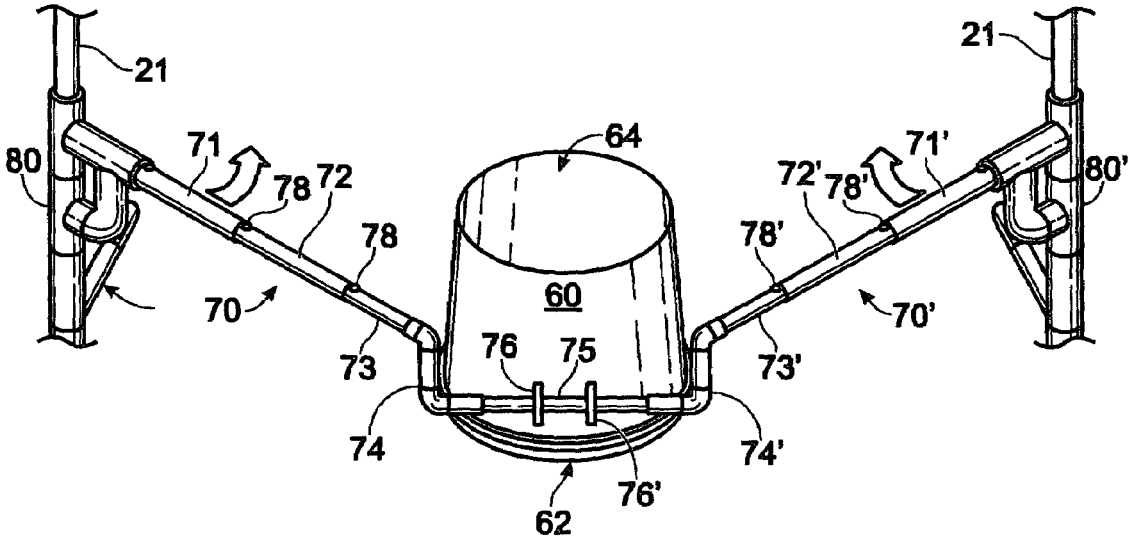
FIG. 3 is a partial front elevational view of the discharge chute and its collapsible support arms, shown with the discharge chute in a non-operable rotated position.

Details of discharge chute 60 and left and right chute support arms 70 and 70' are shown in FIGS. 2 and 3, but the netting has been omitted for sake of clarity.

Discharge chute 60 has an entrance end 62 and an exit or discharge end 64. A rim 66 encircles the entrance end 62, and a cord 68 encircles chute 60 adjacent rim 66. The netting adjacent discharge chute 60 is attached to cord 68.

Discharge chute 60 is supported by two identical left and right telescoping chute support arms 70 and 70'. Left and right chute support arms 70 and 70' include a tubular inner portion 71 and 71', respectively, a tubular middle portion 72 and 72', respectively, a tubular outer portion 73 and 73', respectively, an elbow 74 and 74' attached to the outer ends of outer arm portions 73 and 73', respectively, and a tubular hand member 75. Tubular hand member 75 passes through loosely fitting straps 76 and 76' attached to the outer surface of discharge chute 60, as best seen in FIG. 3. The ends of tubular hand member 75' are attached to rotatable elbows 74 and 74', as shown.

Chute support arms 70 and 71 can be telescoped to an extended position, as shown in FIGS. 1, 2 and 3, or collapsed into a shortened, storage position with discharge chute positioned behind adjacent front posts 20. This telescoping action is accomplished by tubular middle portions 72 and 72' having an outer diameter that is slightly smaller than, the inner diameter of tubular inner portions 71 and 71' and tubular outer portions 73 and 73'. Suitable detents 78 and 78' can be used to keep support arms in their extended position, the net attached to chute 60 preventing separation of tubular middle portions 72 and 72' from tubular inner portions 71 and 71' and tubular outer portions 73 and 73'.

Left and right chute support arms 70 and 71 are attached to left and right front posts 20 by means of left and right elbows 80 and 80'. Left and right elbows 80 and 80' are adapted to swivel around tubular base members 21.

In the preceding description the netting of basketball return device 10 is configured to return basketballs shot essentially while facing the basket, such as throw practice, where the rear net portion 56 is located adjacent the backboard. The return device 10 can be configured to allow practicing shots at side angles. Such other configurations can be effected by having portions of netting on the right and left sides that can be folded up and down so that either the right or left sides can be placed closer to the backboard. In such a configuration the rear net would have a fold-up and fold-down portion also.

In use, the rear end of basketball return device 10, in the fully erected position shown in FIG. 1, is placed under a basketball basket with basketball discharge chute 60 facing the position to be occupied by the shooter. Basketballs shot at the basket which either pass through the basket or slightly miss the basket fall into net 51, rolling downwardly and out through basketball discharge chute 60 towards the shooter.

To collapse basketball return device 10 for storage, telescoping left and right chute support arms 70 and 71 are partially collapsed and discharge chute 60 rotated so that its discharge end 64 faces inwardly and its entrance end 62 faces outwardly, as shown in FIG. 3. Chute support arms 70 and 71 are then rotated in the direction shown by the arrows in FIG. 3 as they are being moved into their fully collapsed position, the netting being omitted forsake of clarity.

Next the user collapses telescoping posts 20 and 20' downwardly, collapses horizontal telescoping side support arms 30 and 30' inwardly, and pushes the front and rear end posts 20 and 20' towards each other to fully collapse the basketball return device 10.

It will be obvious to those having skill in the art that many changes may be made to the details of the above-described embodiments of this invention without departing from the underlying principles thereof. The scope of the present invention should, therefore, be determined only by the following claims.

The invention clamed is:

1. A collapsible basketball return device comprising:

a pair of front vertical telescoping posts and a pair of rear vertical telescoping posts, each of said front and rear posts including a tubular lower portion;

right and left lower horizontal telescoping side support arms extending between said lower tubular portions of each of said front and rear posts, and right and left upper horizontal telescoping side support arm extending between said lower tubular portion of each of said front and rear posts;

front and rear lower horizontal telescoping end support arms extending between said lower tubular portions of said front posts and said rear posts, respectively, and front and rear upper horizontal telescoping support arm extending between said lower tubular portion of said front posts and said rear posts, respectively; and a net having right and left side portions and front and rear end portions that are suspended from said front and rear telescoping posts, said net having an upper end that is open and adapted to receive a basketball when said return device is in its fully erected mode, said side and end portions of said net coming together to form a tunnel sloping downwardly toward and beyond said front posts when said return device is in its fully erected mode, said tunnel having an open outer end that is attached to a basketball discharge chute adapted to receive a basketball and discharge said basketball towards a user.

2. The basketball return device of claim 1 wherein said lower and upper horizontal telescoping side support arms are fixedly attached to said front and rear posts.

3. The basketball return device of claim 1 wherein said lower and upper horizontal telescoping end support arms are rotatably attached to said front and rear posts.

4. The basketball return device of claim 1 wherein said front and rear vertical telescoping posts include a tubular central portion and a tubular upper portion, said tubular upper portion adapted to be inserted into or extended from said tubular central portion, and said tubular central portion adapted to be inserted into or extended from said tubular lower portion.

5. The basketball return device of claim 4 wherein said front and rear telescoping posts include means for releasably locking said tubular central portions and said tubular upper portions into place when they are fully extended.

6. The basketball return device of claim 1 wherein said basketball discharge chute is attached to said front vertical telescoping posts by telescoping and rotatable chute support arms.

7. The basketball return device of claim 1 including wheels attached to the bottoms of each of said tubular lower portions of said front and rear vertical telescoping posts.

8. The basketball return device of claim 1 wherein said right lower horizontal telescoping side support arm is substantially parallel to said right upper horizontal telescoping side support arm, and said left lower horizontal telescoping side support arm is substantially parallel to said left upper horizontal telescoping side support arm.

9. The basketball return device of claim 8 wherein said right and left lower horizontal telescoping side support arms lie substantially in the same plane, and said right and left upper horizontal telescoping side support arms lie substantially in the same plane.

10. The basketball return device of claim 1 wherein said front lower horizontal telescoping end support arm is substantially parallel to said front upper horizontal telescoping end support arm, and said rear lower horizontal telescoping end support arm is substantially parallel to said rear upper horizontal telescoping end support arm.

11. The basketball return device of claim 10 wherein said front and rear lower horizontal telescoping end support arms lie substantially in the same plane, and said front and rear upper horizontal telescoping end support arms lie substantially in the same plane.

12. The basketball return device of claim 1 wherein the height of said right and left side portions and said end portion of said net can be individually adjusted to fit under a basketball goal when said device is in its fully erected position.

13. The basketball return device of claim 1 wherein said end portion of said net has a height that fits under a basketball goal when said device is in its fully erected mode.

* * * * *